US008925743B1

(12) United States Patent
Lee et al.

(10) Patent No.: US 8,925,743 B1
(45) Date of Patent: Jan. 6, 2015

(54) DISH DRYING RACK

(71) Applicant: Helen of Troy Limited, Belleville, St. Michael (BB)

(72) Inventors: Alexander Tze Fung Lee, New York, NY (US); Larry S. Witt, Califon, NJ (US); Paul Lacotta, Tenafly, NJ (US); William Fiebel, Succasunna, NJ (US); Thomas Jason Dooley, Hoboken, NJ (US); Seth David Kranzler, New York, NY (US); Ryan Jonathan Vernon, New York, NY (US); Michael Delevante, Verona, NJ (US); Sunny Kim, Astoria, NY (US); David Lionetti, Cranford, NJ (US)

(73) Assignee: Helen of Troy Limited, Belleville, St. Michael (BB)

( * ) Notice: Subject to any disclaimer, the term of this patent is extended or adjusted under 35 U.S.C. 154(b) by 0 days.

(21) Appl. No.: 14/015,064

(22) Filed: Aug. 30, 2013

(51) Int. Cl.
*A47G 19/08* (2006.01)
*A47L 19/04* (2006.01)
*A47J 47/16* (2006.01)

(52) U.S. Cl.
CPC . *A47L 19/04* (2013.01); *A47J 47/16* (2013.01)
USPC ..... 211/41.6

(58) Field of Classification Search
CPC ..... A47L 19/04; A47L 19/02
USPC ..... 211/41.1–41.9, 85, 85.25, 132.1; 220/533, 571, 572, 485–489; 312/228, 312/229; D32/55, 56; 206/756, 758, 759, 206/762, 565
See application file for complete search history.

(56) References Cited

U.S. PATENT DOCUMENTS

| | | | | | |
|---|---|---|---|---|---|
| 1,487,942 | A | | 3/1924 | Hines et al. | |
| 1,679,594 | A | | 8/1928 | Andrews | |
| 1,714,629 | A | | 5/1929 | Rodin | |
| 2,443,404 | A | * | 6/1948 | Tallarico | 211/41.4 |
| 3,124,254 | A | * | 3/1964 | Davidson | 211/132.1 |
| 3,730,354 | A | * | 5/1973 | Bronstein | 211/38 |
| 3,800,957 | A | * | 4/1974 | Krause | 211/41.3 |
| 3,889,837 | A | * | 6/1975 | Wilson | 220/7 |
| 4,169,638 | A | * | 10/1979 | Cirasuolo et al. | 312/229 |
| 4,221,299 | A | * | 9/1980 | Taylor | 211/41.6 |
| 4,630,745 | A | * | 12/1986 | Shiotani | 220/6 |
| 6,170,676 | B1 | | 1/2001 | Patadia et al. | |

(Continued)

OTHER PUBLICATIONS

International Search Report filed in PCT/US2014/044228 mailed Oct. 30, 2014.

*Primary Examiner* — Joshua Rodden
*Assistant Examiner* — Hiwot Tefera
(74) *Attorney, Agent, or Firm* — Rankin, Hill & Clark LLP

(57) ABSTRACT

A dish drying rack includes a basin, a side bay pivotally connected with the basin for movement about a side bay pivot axis, and a plate rack pivotally connected with the basin for movement about a plate rack pivot axis. The basin includes a basin floor. The side bay moves between a collapsed position and an extended position. The side bay includes a side bay floor. When the side bay is in the extended position, the side bay floor is positioned with respect to the basin such that water drains from the side bay floor toward and onto the basin floor. The plate rack pivot axis is transverse to the side bay pivot axis. The plate rack is movable between an upright position and a flattened position.

20 Claims, 9 Drawing Sheets

FIG. 1

(56) References Cited

U.S. PATENT DOCUMENTS

| | | | | |
|---|---|---|---|---|
| 6,516,956 | B2 * | 2/2003 | Martorella et al. | 211/41.6 |
| 6,929,130 | B2 | 8/2005 | Sampaio | |
| 7,455,184 | B2 | 11/2008 | Yang et al. | |
| 8,087,519 | B2 * | 1/2012 | Bramley et al. | 211/41.3 |
| 2001/0040141 | A1 * | 11/2001 | Martorella et al. | 211/41.6 |
| 2007/0131629 | A1 * | 6/2007 | Sullivan et al. | 211/41.3 |
| 2007/0151937 | A1 * | 7/2007 | Gillisie | 211/41.5 |
| 2008/0149644 | A1 * | 6/2008 | Piacenza et al. | 220/572 |
| 2008/0308509 | A1 * | 12/2008 | Giuseppe | 211/41.3 |
| 2009/0211994 | A1 | 8/2009 | Yang et al. | |

* cited by examiner

DISH DRYING RACK

BACKGROUND

Dish drying racks are commonly used on kitchen counter tops to position dishes, such as plates, bowls, cups and utensils, to allow the dishes to dry after they have been washed. Many dish drying racks are not adjustable or collapsible and, therefore, can take up a lot of space in the kitchen. In addition, dish drying racks that are not adjustable do not lend themselves for use with different types of dishes while maximizing the limited space on the dish rack.

SUMMARY

An example of a dish drying rack that can overcome at least one of the aforementioned shortcomings includes a basin, a side bay pivotally connected with the basin for movement about a side bay pivot axis, and a plate rack pivotally connected with the basin for movement about a plate rack pivot axis. The basin includes a basin floor. The side bay moves between a collapsed position and an extended position. The side bay includes a side bay floor. When the side bay is in the extended position, the side bay floor is positioned with respect to the basin such that water drains from the side bay floor toward and onto the basin floor. The plate rack pivot axis is transverse to the side bay pivot axis. The plate rack is movable between an upright position in which first and second sections of the plate rack extend upwardly from the basin floor and a flattened position in which the first and second sections of the plate rack extend generally parallel with and adjacent to the basin floor.

Another example of a dish drying rack that can overcome at least one of the aforementioned shortcomings includes a basin and a side bay pivotally connected with the basin for movement about a side bay pivot axis. The basin includes a basin floor, a front end wall extending upwardly from the basin floor, and a rear end wall extending upwardly from the basin floor. The side bay is movable between a collapsed position and an extended position. The side bay includes a side bay floor, a forward end wall extending upwardly from the side bay floor, and a back end wall extending upwardly from the side bay floor. When the side bay is in the extended position, the side bay floor is positioned above and with the respect to the basin such that water drains from the side bay floor toward and onto the basin floor. When the side bay is in the extended position, the respective forward end wall is positioned with respect to the front end wall of the basin such that water flowing on the side bay floor towards the forward end wall contacts the forward end wall and is directed toward the basin floor between the front end wall and the rear end wall.

DETAILED DESCRIPTION

Figure 1:
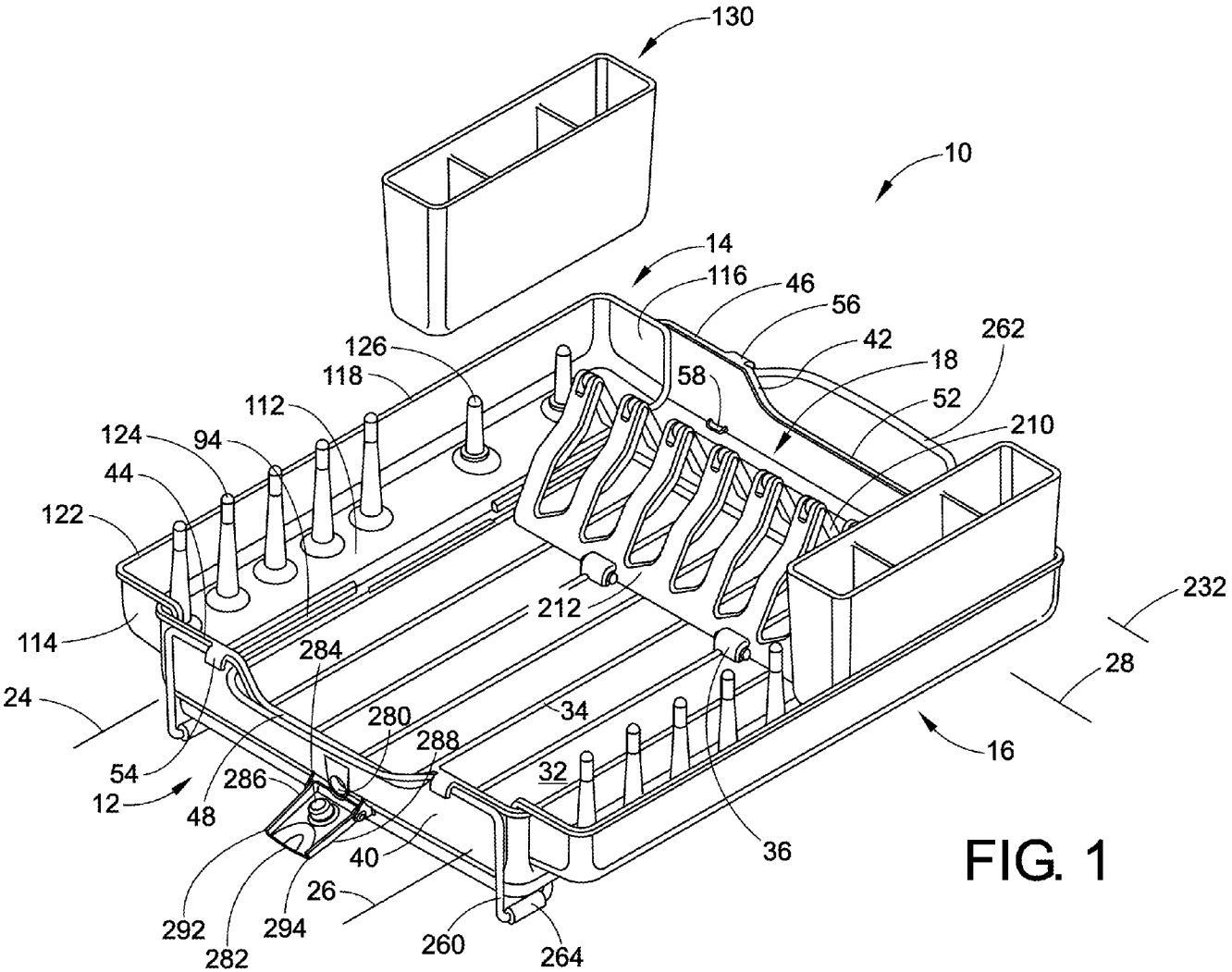
FIG. 1 is a perspective view of the dish drying rack having side bays shown in an extended position.
Figure 2:
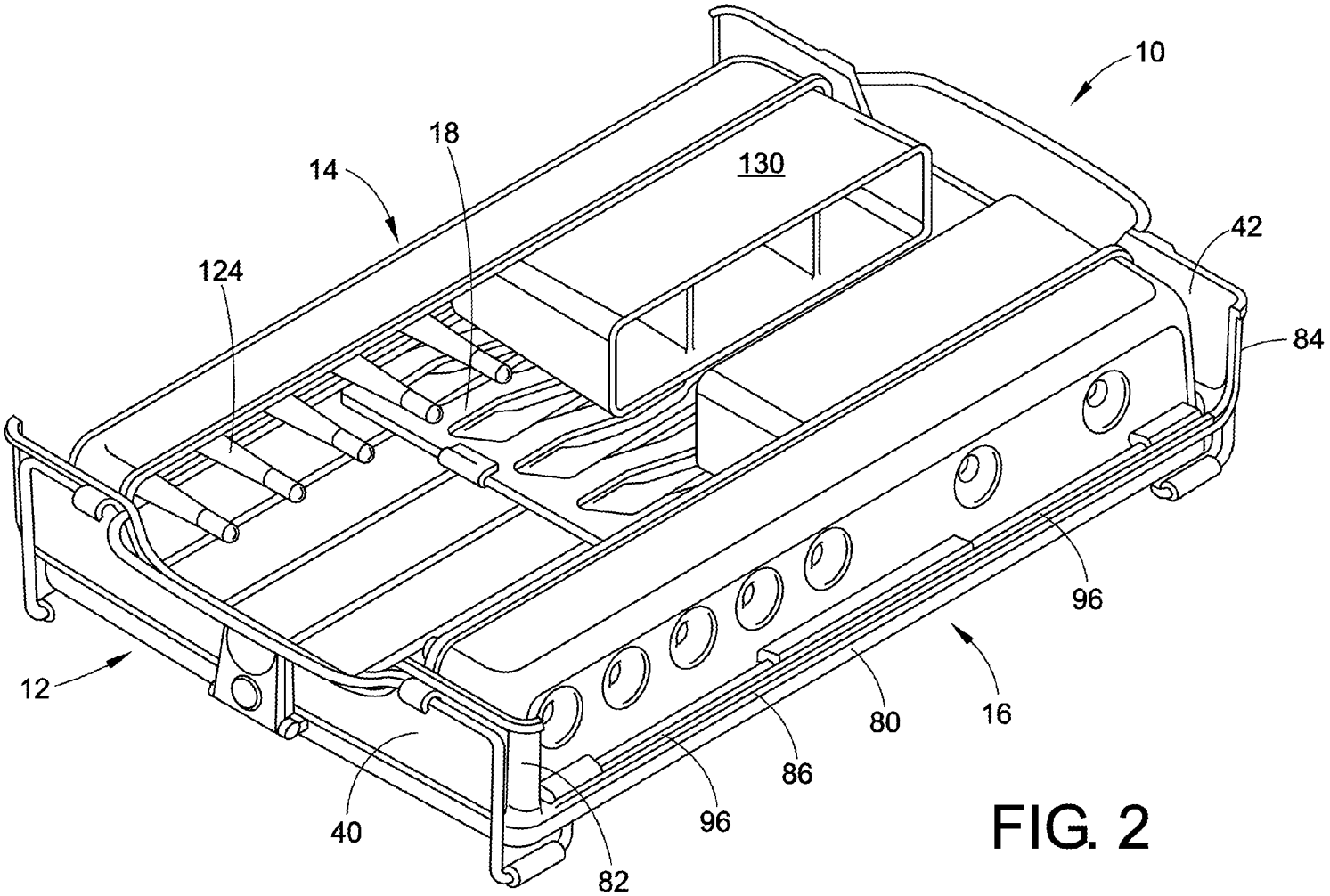
FIG. 2 is a perspective view of the dish drying rack with the side bays shown in a collapsed position.
Figure 3:
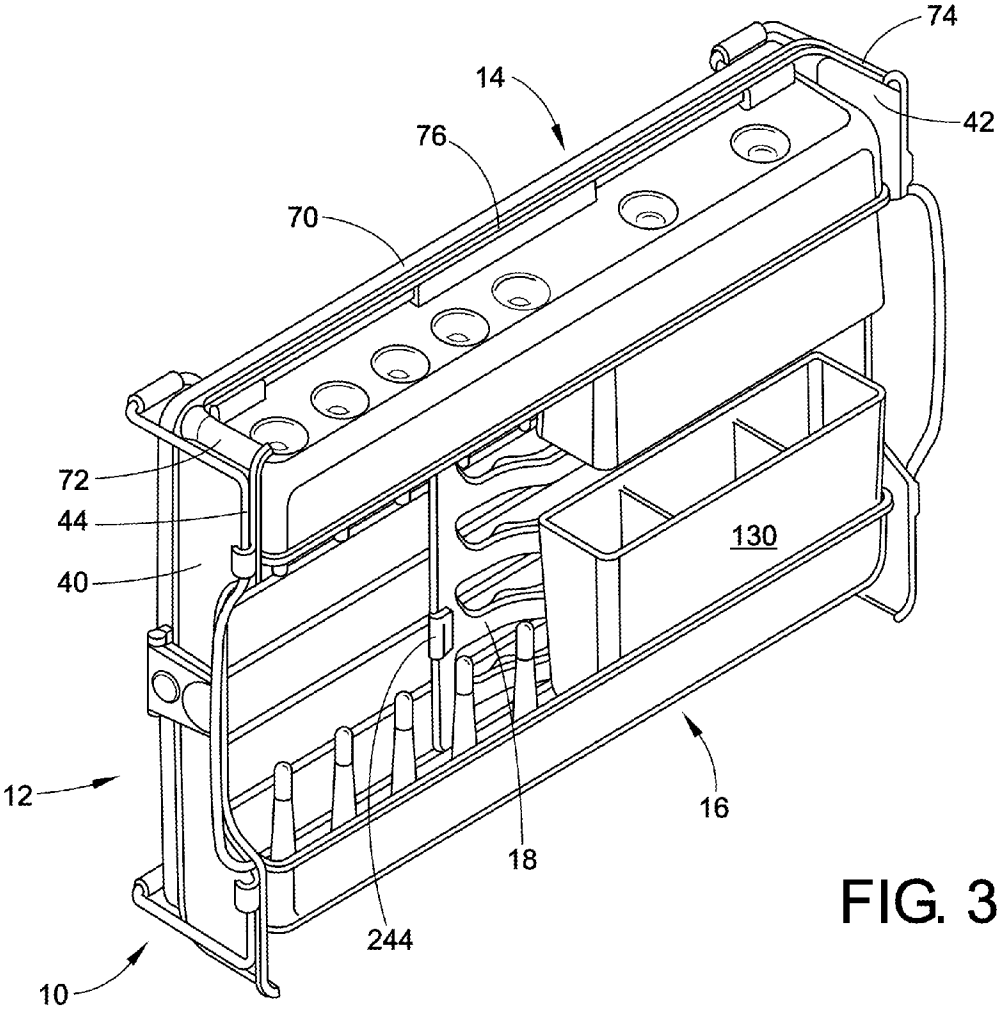
FIG. 3 is a perspective view of the dish drying rack with the side bays shown in the collapsed position and the dish drying rack is positioned on its side.

With reference to FIG. 1, a dish drying rack 10 includes a basin 12 and a side bay 14. The illustrated embodiment includes another side bay 16, and therefore, the side bays will be referred to as the first side bay 14 and the second side bay 16. The dish drying rack 10 further includes a plate rack 18. The dish drying rack 10 is collapsible and adjustable. The first side bay 14 pivotally connects with the basin 12 for movement about a first side bay pivot axis 24. The second side bay 16 pivotally connects with the basin 12 for movement about a second side bay pivot axis 26, which is parallel with the first side bay pivot axis 24. Each side bay 14, 16 is movable between a collapsed position, which is shown in FIGS. 2 and 3, and an extended position, which is shown in FIG. 1. The plate rack 18 pivotally connects with the basin 12 for movement about a plate rack pivot axis 28. The plate rack 18 is movable between an upright position, which is shown in FIG. 1, and a flattened position, which is shown in FIGS. 2 and 3. Due to the movement of each side bay 14, 16 and the plate rack 18, the dish drying rack 10 is adjustable and collapsible.

Figure 4:
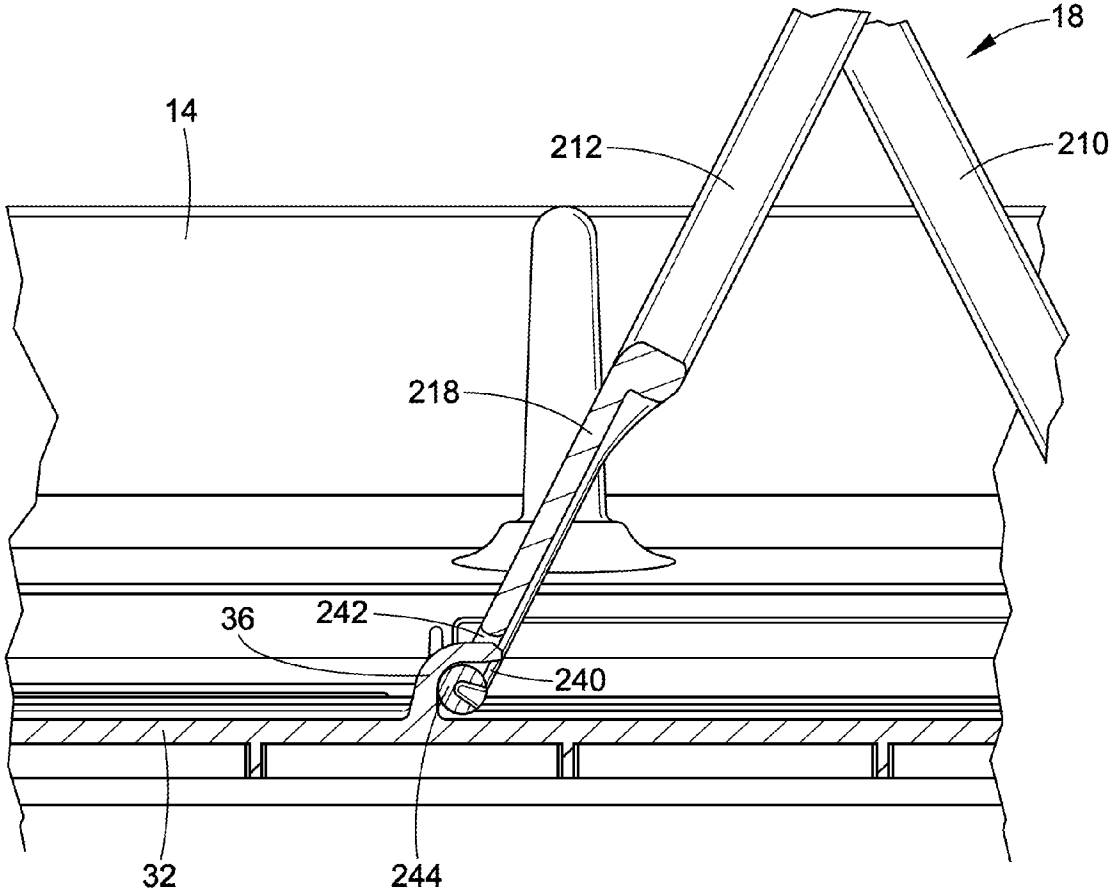
FIG. 4 is a cross-sectional view taken through a catch and a plate rack of the dish drying rack of FIG. 1.

The basin 12 includes a basin floor 32. In the illustrated embodiment, the basin floor 32 was generally horizontal, however, the basin floor 32 can be tilted to direct the flow of water that drains off the dishes positioned on the dish drying rack 10. Ribs 34 are formed on the basin floor 32. The ribs 34 extend in a direction generally parallel to each side bay pivot axis 24, 26. A catch 36 (two catches are shown in the illustrated embodiment) is provided on the basin floor 32. The catches 36 cooperate with the plate rack 18 to lock the plate rack in the upright position (shown in FIG. 1) such that movement of the plate rack 18 with respect to the basin 12 is inhibited. With reference to FIG. 4, each catch 36 is a hook-shaped element that extends upwardly from the basin floor 32.

With reference back to FIG. 1, the basin 12 includes a front end wall 40 and a rear end wall 42 each extending upwardly from the basin floor 32. When the dish drying rack 10 is in a configuration ready to receive dishes to be dried, the front end wall 40 and the rear end wall 32 are generally vertically oriented. The front end wall 40 defines an uppermost front ledge 44 that is offset from the basin floor 32 the same distance that an uppermost rear ledge 46, which is at the top of the rear end wall 42, is offset from the basin floor. The front end wall 40 also includes a front recess 48 that is centrally positioned with respect to the side bays 14, 16 of the dish drying rack 10. The rear end wall 42 includes a rear recess 52, which is also centrally located. Hooks 54 are provided near the uppermost ledge 44 of the front end wall 40. Two hooks 54 are provided, one on one side of the front recess 48 and one on an opposite side of the front recess 48. The hooks 54 extend outwardly (away from the basin floor 32) on the front end wall 40. Rear hooks 56 are also provided on the rear end wall 42 in a location similar to the front end hooks 54.

A detent member 58 is provided on the rear end wall 42. A similar detent member (not shown) in a similar location can be provided on the front wall 40. The detent 58 cooperates with the first side bay 14 to lock the first side bay in the collapsed position (shown in FIGS. 2 and 3) and inhibit movement of the first side bay 14 with respect to the basin 12. Similar detent members can be provided on the front wall 40 and the rear wall 42 to cooperate with the second side bay 16 in a similar manner.

With reference to FIG. 3, the basin 12 also includes a first side wall 70 extending upwardly from the basin floor 32 and extending from the front end wall 40 to the rear end wall 42. The first side wall 70 includes a forward extension 72 having a height (displacement from the basin floor 32) about equal to the height of the front end wall 40. The uppermost ledge 44 continues at the same offset distance from the basin floor 32 and bends over onto the forward extension 72. The first side wall 70 also includes a rearward extension 74 having a height about equal to the height of the rear end wall 42 and the height of the forward extension 72. The forward extension 42 can make up a front corner of the basin 12 and includes a portion that is disposed generally perpendicular to the front end wall 40. Similarly, the rearward extension 74 can also make up a rear corner of the basin 12 and include a portion that is disposed generally perpendicular to the rear end wall 42. A recess 76 is defined between the forward extension 72 and the rearward extension 74. With reference back to FIG. 1, the first side bay 14 is received in the recess 76 of the first side wall 70 when the side bay is in the extended position. With reference to FIG. 2, the basin 12 also includes a second side wall 80 on an opposite side of the dish drying rack 10 as the first side wall 70. The second side wall 80 also extends from the front end wall 40 to the rear end wall 42. The second side wall 80 also includes a forward extension 82 and a rearward extension 84 that is the same in configuration as the forward extension 72 and the rearward extension 74 of the first side wall 70. The second side wall 80 also includes a recess 86 positioned between the forward extension 82 and the rearward extension 84. The configuration of the second side wall 80 is the same as the configuration of the first side wall 70, and therefore further description thereof has been omitted.

With reference back to FIG. 1, first side bay axle mounts 94 are provided on the basin floor 32 for connecting the first side bay 14 with the basin 12. The first side bay axle mounts 94 are elongate arc-shaped elements that extend upwardly from the basin floor 32 and include a passage or hole (not visible) coaxial with the first side bay pivot axis 24. Each first side bay axle mount 94 is offset slightly inwardly from the first side wall 70. With respect to FIG. 2, second side bay axle mounts 96 are provided on an opposite side of the basin floor 32. The second side bay axle mounts 96 cooperate with the second side bay 16 to connect the second side bay to the basin 12. The second side bay axle mounts 96 are similar in configuration to the first side bay axle mounts 94. The second side bay axle mounts 96 also include a hole or passage that is coaxial with the second side bay pivot axis 26. The second side bay axle mounts 96 are also offset slightly inwardly from the second side wall 80.

Figure 5:
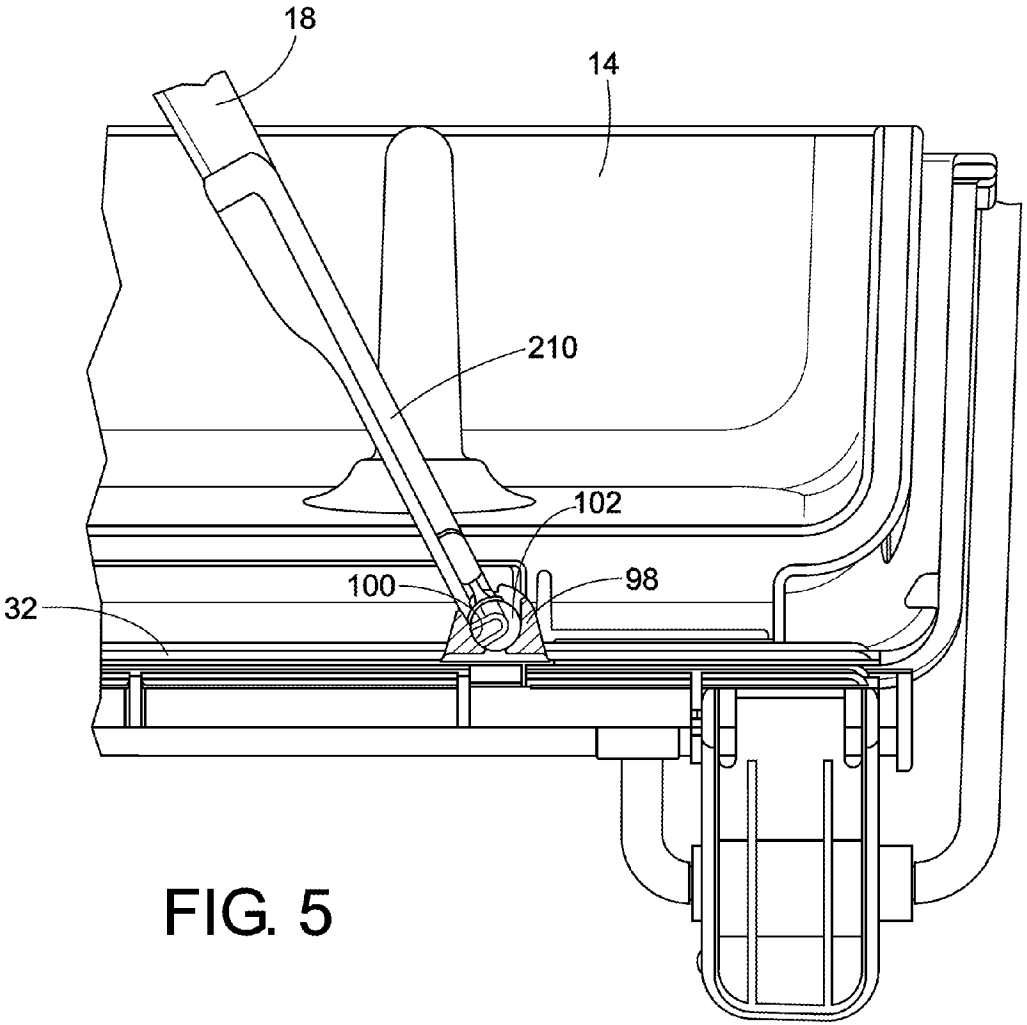
FIG. 5 is a cross-sectional view taken through a plate rack pivot mount and the plate rack of the dish drying rack of FIG. 1.

With reference to FIG. 5, plate rack pivot mounts 98 (only one shown) are also provided on the basin floor 32 for pivotally connecting the plate rack 18 with the basin 12. Only one plate rack pivot mount 98, which is nearer the first side bay 14, is shown in FIG. 5; however, a second plate rack pivot mount is provided nearer the second side bay 16. Each plate rack pivot mount 98 includes an opening 100 that is coaxial with the plate rack pivot axis 28 (FIG. 1). Each plate rack pivot mount 98 can receive an axle or hub 102 that is part of the plate rack 18 to allow the plate rack 18 to pivot with respect to the basin 12 about the plate rack pivot axis 28.

Figure 6:
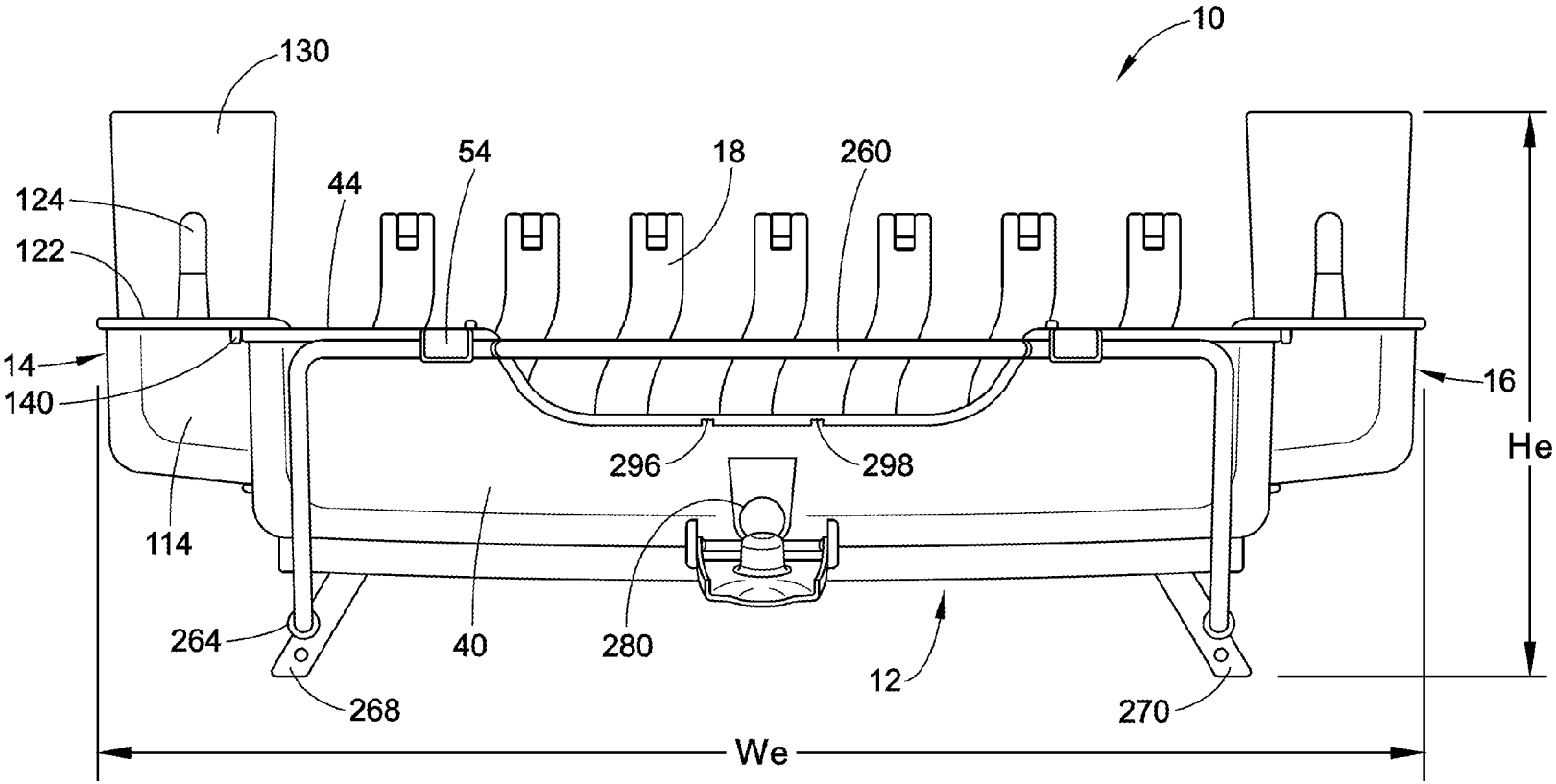
FIG. 6 is a front elevation of the dish drying rack with the side bays shown in the extended position.
Figure 7:
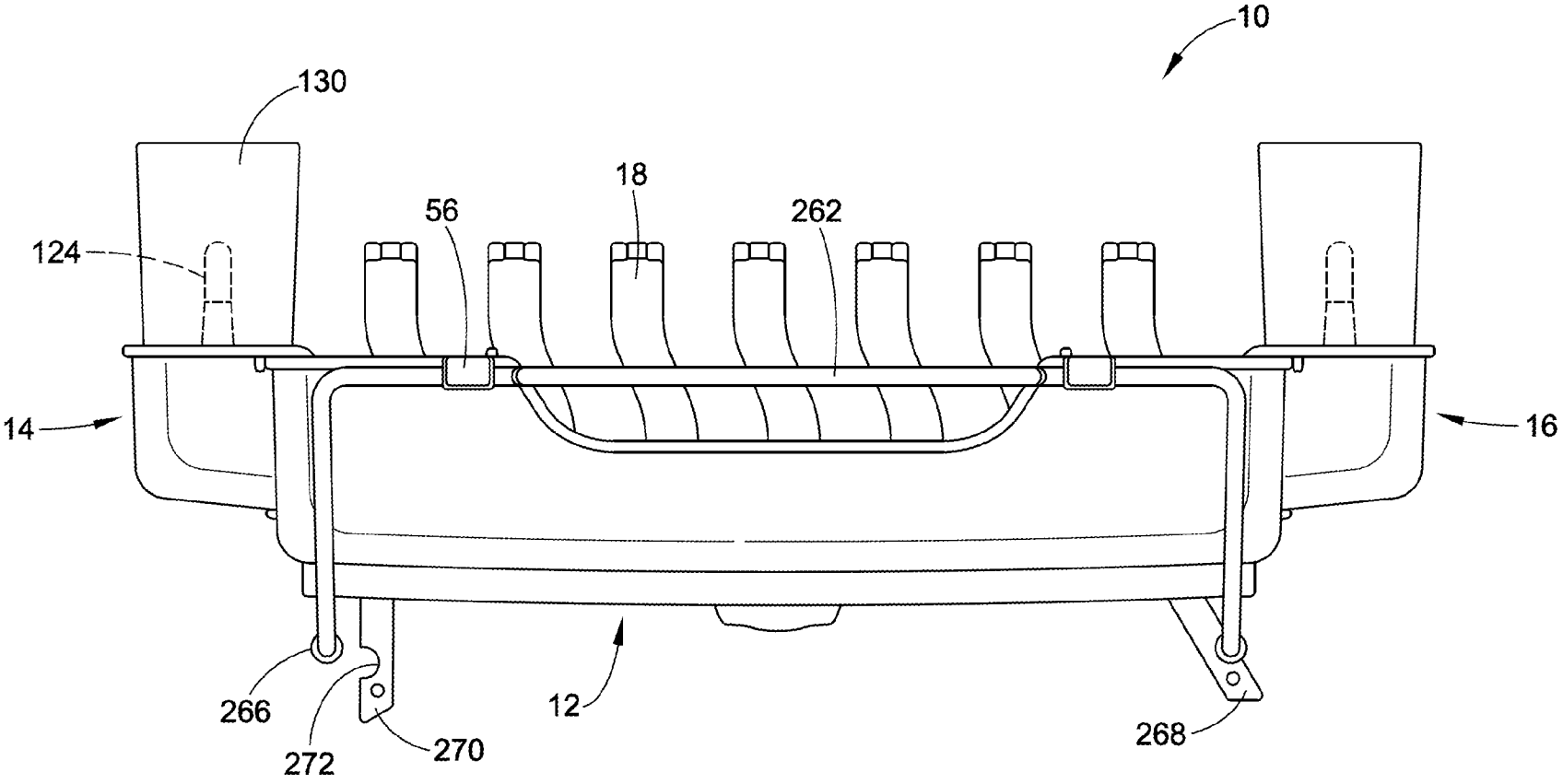
FIG. 7 is a rear elevation of the dish drying rack with the side bays shown in the extended position.

The first side bay 14 is a mirror image of the second side bay 16. Accordingly, the first side bay 14 will be described with particularity with the understanding that the second side bay 16 has a similar configuration. The first side bay 14 includes a side bay floor 112. When the first side bay 14 is in the extended position (shown in FIG. 1), the side bay floor 112 is generally horizontally disposed and positioned with respect to the basin 12 such that water drains from the side bay floor 112 toward and onto the basin floor 32. The first side bay 14 also includes a forward end wall 114 and a back end wall 116 each extending upwardly from the side bay floor 112. The first side bay 14 also includes an outer side wall 118 extending from the forward end wall 114 to the back end wall 116. The forward end wall 114, the outer side wall 118, and the back end wall 116 define a free edge 122 of the first side bay 14. With reference to FIGS. 6 and 7, the free edge 122 resides in nearly the same plane as the forward uppermost ledge 44 and the rear uppermost ledge 46 to limit the overall height $H_e$ of the dish drying rack 10 when the first side bay 14 is in the extended position. When the first side bay 14 is in the extended position, the forward end wall 114 of the first side bay 14 is positioned with respect to the front end wall 40 of the basin 12 such that water flowing on the side bay floor 112 towards the forward end wall 114 contacts the forward end wall and is directed toward the basin floor 32 between the front end wall 40 and the rear end wall 42 of the basin 12. In other words, water does not leak from the dish dry rack 10 at an interface between the first side bay 14 and the basin 12. Instead the water on the first side bay 14 is directed toward the basin 12. As illustrated, the front end wall 114 of the first side bay 14 is substantially parallel with the forward end wall 40 of the basin 12. Likewise, the rear end wall 42 of the basin 12 is substantially parallel with the back end wall 116 of the first side bay 14. The forward end wall 114 of the first side bay 14 is adjacent to an offset inwardly from the front end wall 40 of the basin 12. The back end wall 116 of the first side bay 14 is adjacent to and offset inwardly from the rear end wall 32 of the basin 12.

The first side bay 14 also includes taller tines 124 and shorter tines 126. The tines 124, 126 extend away from the side bay floor 112 in a similar direction as the walls 114, 116, 118. Each tine 124, 126 defines a central axis that is generally normal to the side bay floor 112. The taller tines 124 are configured to cooperate with cups and glasses to position these items appropriately for drying. The taller tines 124 extend further away from the side bay floor 112 as compared to the walls 114, 116, 118. The smaller tines 126 cooperate with a utensil receptacle 130. The utensil receptacle includes openings 132 (shown in phantom) that receive the shorter tines 126 to fix the utensil receptacle 130 with respect to the first side bay 14. As seen when comparing FIG. 1 to FIGS. 2 and 3, distal ends 134 of the taller tines 124 are positioned further away from the basin floor 32 when the first side bay 14 is in the extended position (shown in FIG. 1) as compared to when the first side bay 14 is in the collapsed position (shown in FIGS. 2 and 3). The tines 124, 126 are positioned generally perpendicular with the basin floor 32 when the first side bay 14 is in the extended position. The tines 124, 126 are positioned generally parallel with the basin floor 32 when the first side bay 14 is in the collapsed position. Also, at least one of the forward end wall 114 and the back end wall 116 of the first side bay 14 contacts at least one of the basin floor 32 and the plate rack 18 when the first side bay is in the collapsed position.

To lock the first side bay 14 in the extended position, a detent member 140 on the forward end wall 114 engages the uppermost forward ledge 44 on the basin 12. The detent member 140 is positioned below the free edge 122 of the first side bay 14 and contacts the uppermost forward ledge 44 of the basin 12 when the first side bay is in the extended position (see FIG. 6). To lock the first side bay 14 in the collapsed position (see FIGS. 2 and 3), the free edge 122, which can have a similar ledge-like configuration as the uppermost forward ledge 44, engages the detent member 58 visible in FIG. 1. The detent member 58 engages the free edge 122 to preclude movement of the first side bay 14 with respect to the basin 12. More detent members can be provided in similar locations in the basin 12, which allows the dish drying rack 10 to be stored on a side, which is shown in FIG. 3, and the lower side bay, which is the second side bay 16 shown in FIG. 3, will not fall pivot away from the basin 12.

Figure 8:
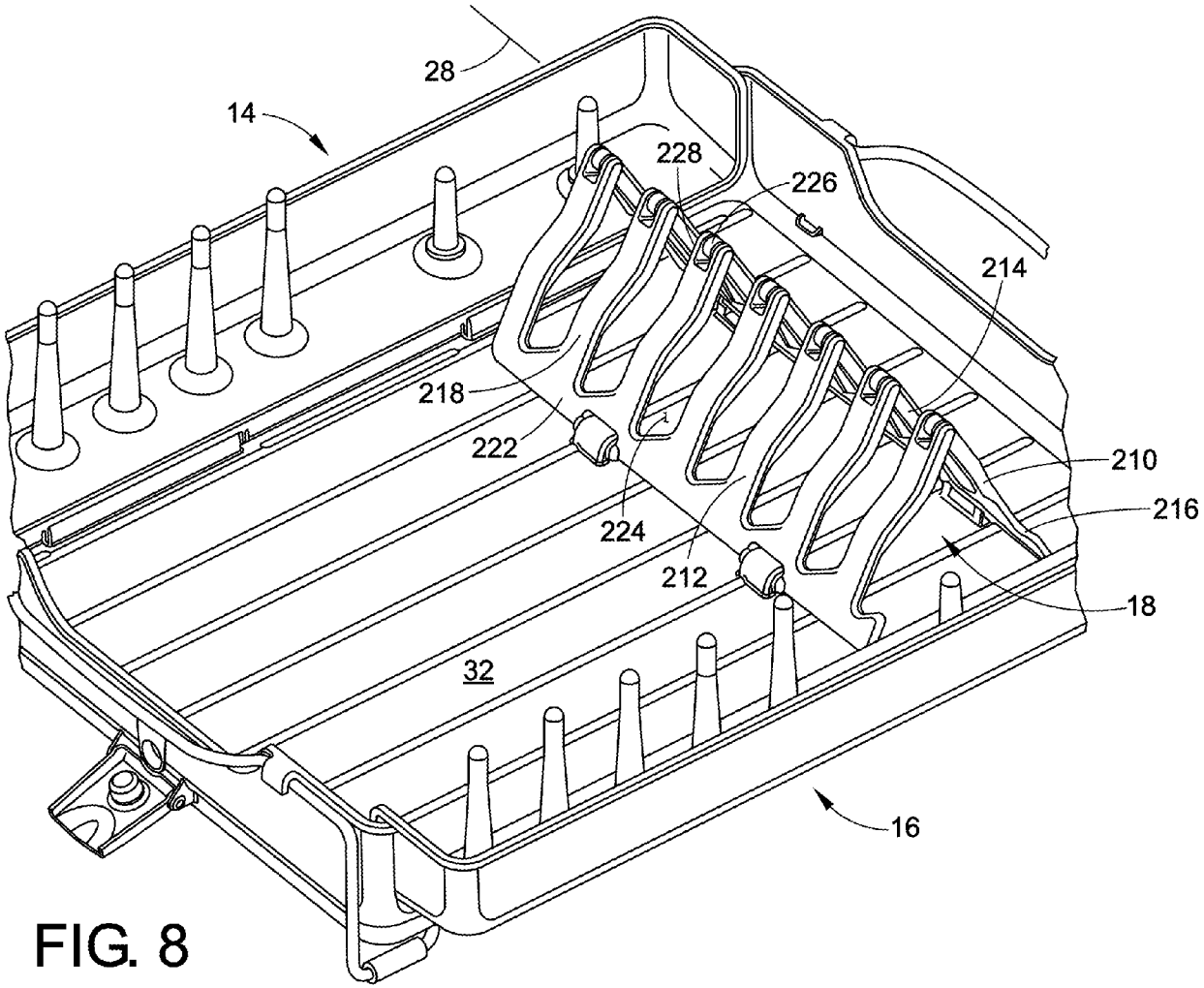
FIG. 8 is a perspective view showing a plate rack of the dish drying rack of FIG. 1.

With respect to FIG. 8, the plate rack 18 pivotally connects with the basin 12 for movement about the plate rack pivot axis 28, which can be referred to as the first plate rack pivot axis 28. The first plate rack pivot axis 28 is transverse to the first side bay pivot axis 24 and the second side bay pivot axis 26 (FIG. 1). As illustrated, the first plate rack pivot axis 28 is perpendicular to each side bay pivot axis 24, 26. The plate rack 16 is movable between an upright position (shown in FIGS. 1 and 8) in which a first section 210 and a second section 212 of the plate rack 18 each extend upwardly from the basin floor 32 and a flattened position (shown in FIGS. 2 and 3) in which the first and second sections of the plate rack extend generally parallel with and adjacent to the basin floor. The first section 210 of the plate rack 18 pivots with respect to the basin floor 32 about the first plate rack pivot axis 28. The first section 210 of the plate rack 18 includes a plurality of slats 214 extending away from a base section 216. The second section 212 of the plate rack 18 also includes a plurality of slats 218 extending from a base section 222. As such, each of the first section 210 and the second section 212 of the plate rack 18 includes a plurality of slats 214, 218 extending away from a respective base section 216, 222 to define a plurality of recesses 224 in which plates can be inserted. Each distal end 226 of a respective slat 214 of the first section 210 pivotally connects with a respective distal end 228 of a respective slat 218 of the second section 212 of the plate rack 18. Due to this connection, a second plate rack pivot axis about which each distal end 226 of a respective slat 214 of the first section 210 pivots with respect to a respective distal end 228 of a respective slate 218 of the second section 212. A second plate rack pivot axis 232 is generally parallel with the first plate rack pivot axis 28 and is perpendicular to the side bay pivot axis 24, 26. The connection of the slats 214, 218 at the second plate rack pivot axis 232 can be made by an axle, hub, a living hinge, or similar type connection that would allow first section 210 to pivot with respect to the second section 212 about the second plate rack pivot axis 232. In the illustrated embodiment, each slat 214, 218 is generally dogleg shaped. The base section 216 of the first section 210 and the base section 222 of the second section 212 each defines a lower boundary of each recess 224, respectively. As such, each base section 216, 222 is configured to provide a support surface for a dish positioned in a respective recess 224.

As more clearly seen in FIG. 4, the catch 36 on the basin floor 32 cooperates with the second section 212 of the plate rack 18 to lock the plate rack in the upright position (shown in FIG. 1) such that movement of the second section 212 with respect to the basin 12 is inhibited. The catch 36 is a hook-shaped element having an opening 240 facing toward the first section 210 of the plate rack 18. The second section 212 includes an opening 242 and a strike 244 adjacent to the opening 242. The strike 244 is received in the opening 240 of the catch 36 to fix the second section 212 of the plate rack 18 with respect to the basin 12. The second section 212 of the plate rack 18 is slid over the catch 36 when moving from the flattened position (shown in FIGS. 2 and 3) toward the upright-locked position. Due to the angled configuration of the slats 214, 218, which are generally triangular in configuration normal to the pivot axis 28, 232, the catch 36 is configured to counteract a horizontal force component to preclude movement of the plate rack 18 with respect to the basin 12.

The plate rack 18 is able to accommodate many dishes. The base section 216 of the first section 210 of the plate rack and the base section 222 of the second section 212 of the plate rack each extend from a first side (adjacent the first side bay 14) of the basin 12 toward the second side (adjacent to the second side bay 16) over at least 90% of the distance separating the first side from the second side. If desired, the plate rack 18 can be split such that one section of the plate rack is positioned in the upright position shown in FIG. 1 while another section of the plate rack can be in the flattened position shown in FIGS. 2 and 3.

The dish drying rack 10 includes a forward wire frame 260 that connects with the basin 12 through the forward catches 54 and a rear wire frame 262 that connects with the basin 12 through the rear catches 56. Forward feet 264 are provided on the forward wire frame 260. Rear feet 266 are provided on the rear wire frame 262. The basin 12 can be positioned so that there is a slight angle toward a drain opening 280 provided through front end wall 40 of the basin 12. Pivoting legs 268, 270 attach to an under surface of the basin 12 near each rear corner. Each leg 268, 270 can pivot between a stowed position (shown in FIG. 6) where the leg is positioned against the under surface of the basin 12 and an extended position where the leg projects away from the basin. Each leg 268, 270 also includes a recess 272 (only one being clearly visible in FIG. 7). The rear feet 266 can be received in the recesses 272 when the leg 270 is in the extended position to tilt the basin floor 32.

Figure 9:
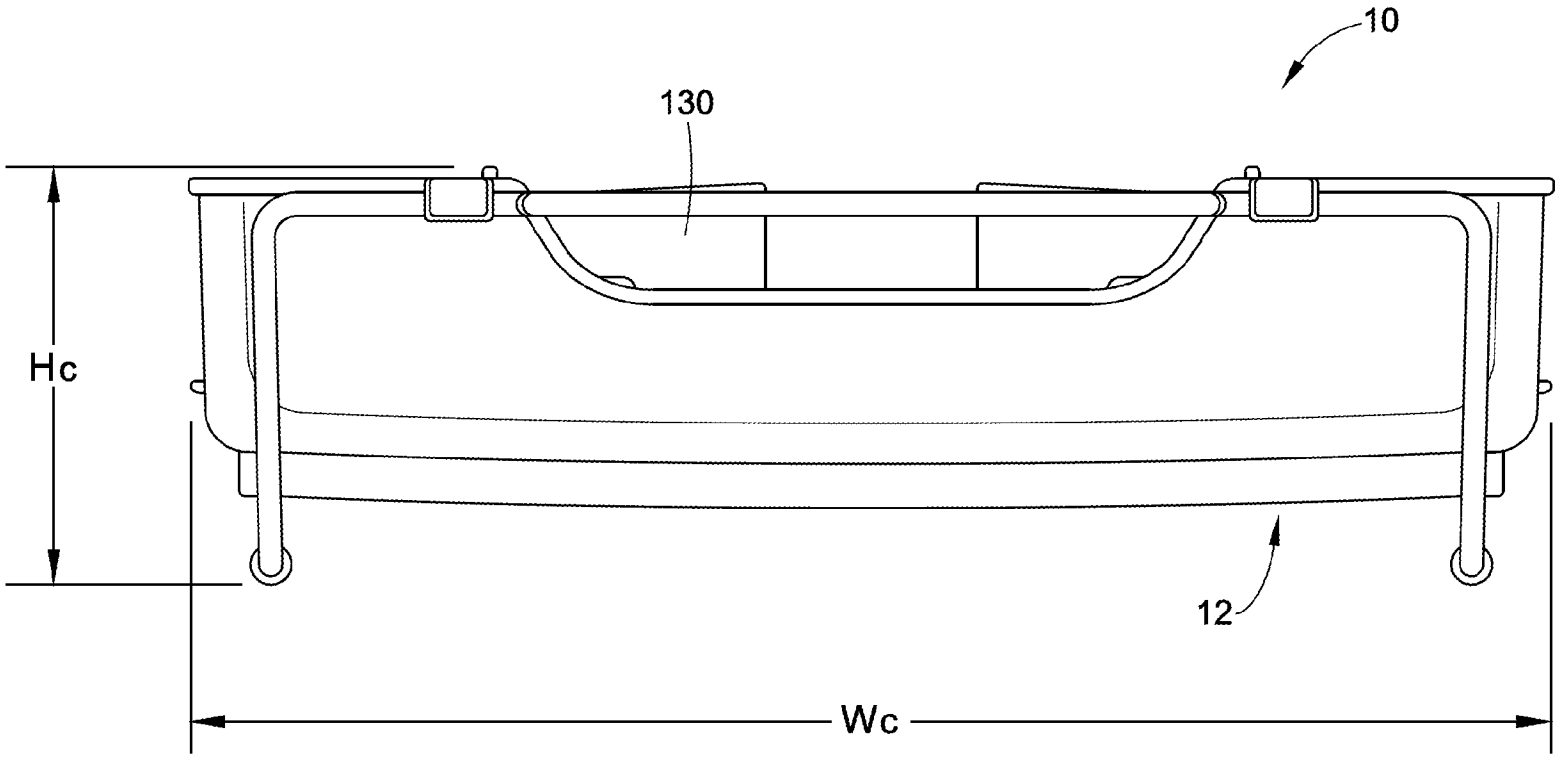
FIG. 9 is a front elevation of the dish drying rack with the side bays shown in the collapsed position.

The first side bay 14 can be pivoted into the extended position and the second side bay 16 can also be pivoted into the extended position. With the side bays 14, 16 in the extended position, the overall width $W_e$ (FIG. 6) of the dish drying rack 10 is greater than the overall width $W_c$ (FIG. 9) of the dish drying rack with the side bays in the collapsed position. Also, with the side bays 14, 16 in the extended position, the overall height $H_e$ (FIG. 6) is greater than the overall height $H_c$ (FIG. 9) when the side bays are in the collapsed position. As such, the volumetric space taken up by the dish drying rack 10 while in the collapsed position is reduced as compared to the when the side bays 14, 16 of the dish drying rack are in the extended position. This allows the dish drying rack 10 to be neatly collapsed into a smaller volume for storage. Moreover, with the detent mechanisms provided, the side bays 14, 16 stay in the collapsed position even when the dish rack is stored on one of its side as shown in FIG. 3.

The plate rack 18 can be positioned in the upright position while the side bays 14, 16 are in the extended position. Alternatively, the plate rack 16 can also be moved into the flattened position while the side bays 14, 16 remain in the extended position. This configuration may be desirable when pots or larger items are to be dried on the dish rack.

As mentioned above, water flows from the side bays 14, 16 onto the basin floor 32 and toward the drain opening 280. If desired, the drain opening 280 can be plugged. A drain cover 282 pivotally attaches to the basin 12. The drain cover 282 is movable between an open position (shown in FIG. 1) and a closed position (shown in FIGS. 2 and 3). A plug 284 is disposed on the drain cover 282. The plug 284 is received in the drain opening 280 when the drain cover 282 is in the closed position. Water from the drain opening 280 falls onto the drain cover 282 and can be retained by a first side edge 286 and a second side edge 288 on an opposite side of the drain cover. The water is directed toward the free end 282 where it can drain into the kitchen sink. The drain cover 282 includes a free end 284 that cooperates with uppermost edge 44 formed on the front end wall 40 of the basin 12 to provide a latching connection to maintain the drain cover 282 in the closed position. Projections 292, 294 on the distal end of each side edge 286, 288, respectively, fit into notches 296, 298 when the drain cover 282 is in the closed position.

A dish drying rack has been described above with particularity. Modifications and alterations will occur to those upon reading and understanding the preceding detailed description. The invention is not limited only to the embodiments described above. Instead, the invention is broadly defined by the appended claims and the equivalents thereof. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A dish drying rack comprising:

a basin including a basin floor, a front end wall and a rear end wall each extending upwardly from the basin floor;

a side bay pivotally connected with the basin for movement about a side bay pivot axis between a collapsed position and an extended position, the side bay including a side bay floor, when the side bay is in the extended position the side bay floor is positioned with respect to the basin such that water drains from the side bay floor toward and onto the basin floor, wherein the side bay further includes a forward end wall and a back end wall each extending upwardly from the side bay floor, when the side bay is in the extended position the forward end wall is positioned with respect to the front end wall such that water flowing on the side bay floor towards the forward end wall contacts the forward end wall and is directed toward the basin floor between the front end wall and the rear end wall; and a plate rack pivotally connected with the basin for movement about a plate rack pivot axis, which is transverse to the side bay pivot axis, the plate rack being movable between an upright position in which a first section and a second section of the plate rack extend upwardly from the basin floor and a flattened position in which the first section and the second section of the plate rack extend generally parallel with and adjacent to the basin floor.

2. The dish drying rack of claim 1, wherein the plate rack pivot axis is perpendicular to the side bay pivot axis.

3. The dish drying rack of claim 1, further comprising a catch on the basin floor, wherein the catch cooperates with the second section of the plate rack to lock the plate rack in the upright position in which movement of the second section with respect to the basin is inhibited, wherein the catch is a hook-shaped element having an opening facing toward the first section of the plate rack, wherein the second section of the plate rack is slid over the catch when moving from the flattened position toward the upright position.

4. The dish drying rack of claim 1, wherein each of the first section and the second section of the plate rack includes a plurality of slats extending away from a respective base section to define a plurality of recesses in which associated plates can be inserted, wherein each distal end of a respective slat of the first section pivotally connects with a respective distal end of a respective slat of the second section.

5. The dish drying rack of claim 4, wherein the plate rack pivot axis includes a first plate rack pivot axis about which the first section of the plate rack pivots with respect to the basin floor and a second plate rack pivot axis about which each distal end of a respective slat of the first section pivots with respect to a respective distal end of a respective slat of the second section.

6. The dish drying rack of claim 4, wherein the side bay is a first side bay connected with the basin adjacent a first side of the basin, the dish drying rack further includes a second side bay connected with the basin adjacent a second side, which is opposite the first side, of the basin, wherein the base section of each of the first section and the second section of the plate rack extends from the first side toward the second side of the basin over at least 90% of a distance separating the first side from the second side.

7. The dish drying rack of claim 4, wherein each slat is generally dogleg shaped.

8. The dish drying rack of claim 4, wherein the base section of both the first section and the second section of the dish drying rack each defines a lower boundary of each recess, respectively, and each base section is configured to provide a support surface for a dish positioned in a respective recess.

9. The dish drying rack of claim 1, wherein the side bay includes at least one tine extending upwardly from the side bay floor, wherein a distal end of the at least one tine is positioned further away from the basin floor when the side bay is in the extended position as compared to when the side bay is in the collapsed position.

10. The dish drying rack of claim 9, wherein the at least one tine is positioned generally perpendicular with the basin floor when the side bay is in the extended position, and the at least one tine is positioned generally parallel with the basin floor when the side bay is in the collapsed position.

11. The dish drying rack of claim 1, wherein the dish drying rack has an overall height $H_e$ when the side bay is in the extended position and an overall height $H_c$ when the side bay is in the collapsed position, wherein $H_e$ is greater than $H_c$.

12. The dish drying rack of claim 11, wherein the dish drying rack has an overall width $W_e$ when the side bay is in the extended position and an overall width $W_c$ when the side bay is in the collapsed position, wherein $W_e$ is greater than $W_c$.

13. The dish drying rack of claim 1, wherein the front end wall is substantially parallel with the forward end wall and the rear end wall is substantially parallel with the back end wall.

14. The dish drying rack of claim 1, wherein the basin includes a side wall extending upwardly from the basin floor and extending from the front end wall to the rear end wall, wherein the side wall includes a forward extension having a height about equal to the front end wall and a rearward extension having a height about equal to the rear end wall, wherein the forward extension is disposed generally perpendicular to the front end wall and the rearward extension is disposed generally perpendicular to the rear end wall and a recess is defined between the forward extension and the rearward extension, wherein the side bay is received in the recess when the side bay is in the extended position.

15. The dish drying rack of claim 14, wherein the side bay includes at least one tab that cooperates with at least one of the forward extension and the rearward extension to limit movement of the side bay from the collapsed position beyond the extended position.

16. A dish drying rack comprising:

a basin including a basin floor, a front end wall extending upwardly from the basin floor, and a rear end wall extending upwardly from the basin floor;

a side bay pivotally connected with the basin for movement about a side bay pivot axis; and a plate rack pivotally connected with the basin for movement about a plate rack pivot axis, which is generally perpendicular to the side bay pivot axis, the plate rack being movable between an upright position in which first and second sections of the plate rack extend upwardly from the basin floor and a flattened position in which the first and second sections of the plate rack extend generally parallel with the basin floor;

wherein the side bay is movable between a collapsed position and an extended position, wherein the side bay includes a side bay floor, a forward end wall extending upwardly from the side bay floor, and a back end wall extending upwardly from the side bay floor, when the side bay is in the extended position the side bay floor is positioned above and with respect to the basin such that water drains from the side bay floor toward and onto the basin floor, and when the side bay is in the extended position the respective forward end wall is positioned with respect to the front end wall of the basin such that water flowing on the side bay floor towards the forward end wall contacts the forward end wall and is directed toward the basin floor between the front end wall and the rear end wall.

17. The dish drying rack of claim 16, wherein at least one of the forward end wall and the back end wall contacts at least one of the basin floor and the plate rack when the side bay is in the collapsed position.

18. The dish drying rack of claim 16, wherein the forward end wall is adjacent to and offset inwardly from the front end wall and the back end wall is adjacent to and offset inwardly from the rear end wall.

19. The dish drying rack of claim 16, wherein the side bay includes a ledge and the basin includes a detent member, wherein the ledge cooperates with the detent member such that when the side bay is in the collapsed position and drying rack is positioned resting on a side wall movement of the side bay away from the basin floor is inhibited.

20. A dish drying rack comprising:

a basin including a basin floor;

a side bay pivotally connected with the basin for movement about a side bay pivot axis between a collapsed position and an extended position, the side bay including a side bay floor, when the side bay is in the extended position the side bay floor is positioned with respect to the basin such that water drains from the side bay floor toward and onto the basin floor;

a plate rack pivotally connected with the basin for movement about a plate rack pivot axis, which is transverse to the side bay pivot axis, the plate rack being movable between an upright position in which a first section and a second section of the plate rack extend upwardly from the basin floor and a flattened position in which the first section and the second section of the plate rack extend generally parallel with and adjacent to the basin floor; and a catch on the basin floor, wherein the catch cooperates with the second section of the plate rack to lock the plate rack in the upright position in which movement of the second section with respect to the basin is inhibited, wherein the catch is a hook-shaped element having an opening facing toward the first section of the plate rack, wherein the second section of the plate rack is slid over the catch when moving from the flattened position toward the upright position.

* * * * *